US005743321A

United States Patent [19]

Joern et al.

[11] Patent Number: 5,743,321

[45] Date of Patent: Apr. 28, 1998

[54] PROCESS FOR THE PRODUCTION OF PARTS WITH A SPIRALLY SYMMETRICAL OUTER CONTOUR

[75] Inventors: Friedrich-W. Joern, Battenbarg; Rolf Dieterich, Horb; Wolfgang Sandkoetter, Herrenberg, all of Germany

[73] Assignee: Bitzer Kuehlmaschinenbau GmbH & Co. KG, Sindelfingen, Germany

[21] Appl. No.: 622,742

[22] Filed: Mar. 27, 1996

Related U.S. Application Data

[63] Continuation of PCT/EP95/02762 published as WO96/03237 Feb. 8, 1996.

[30] Foreign Application Priority Data

Jul. 27, 1994 [DE] Germany ..... 44 26 567.0
Aug. 31, 1994 [DE] Germany ..... 44 30 890.6

[51] Int. Cl.[6] ..... B22C 9/22; B22D 25/02

[52] U.S. Cl. ..... 164/44; 164/47; 164/137

[58] Field of Search ..... 164/44, 47, 137

[56] References Cited

U.S. PATENT DOCUMENTS 3,267,527 8/1966 Brown ..... 164/44
3,461,949 8/1969 Nilson ..... 164/44 X
4,899,799 2/1990 Drazy ..... 164/44 X

FOREIGN PATENT DOCUMENTS 0212459 3/1987 European Pat. Off. .
72 24 272 1/1973 Germany .
26 07 684 2/1977 Germany .
3506475 8/1986 Germany .
2229121 9/1990 United Kingdom .

*Primary Examiner*—J. Reed Batten, Jr.
*Attorney, Agent, or Firm*—Barry R. Lipsitz; Ralph F. Hoppin

[57] ABSTRACT

A casting mold member is produced from a master which has a section with a spirally symmetrical outer contour such that the casting mold member surrounds the section in an azimuthally closed manner with respect to the axis of symmetry. The casting mold member is used to provide a casting mold. The casting mold member is filled by feeding a cast iron melt, and solidifying the melt by using a graphitization pressure to prevent cavities and pores in the casting and by chilling the melt to obtain shell hardening.

17 Claims, 5 Drawing Sheets

20
22
38
14
36
30
16
18
10
12
2
2
32
34

PROCESS FOR THE PRODUCTION OF PARTS WITH A SPIRALLY SYMMETRICAL OUTER CONTOUR

BACKGROUND OF THE INVENTION

This application is a continuation of International PCT Application No. PCT/EP95/02762, filed on Jul. 14, 1995, published as WO96/03237 Feb. 8, 1996.

The invention relates to a process for the production of parts made of cast iron, in particular rotors for screw compressors, comprising a section which has an outer contour spirally symmetrical to an axis of symmetry.

The production of parts having a spirally symmetrical outer contour in certain sections is carried out, for example, either starting from an edge material or from a forged or a cast roll, into which the spirally symmetrical outer contour is worked by means of machining processes, for example milling, high speed milling or grinding.

With these known methods a complicated abrasive machining is required which has, on the one hand, a high expenditure of material and, on the other hand, considerable machining requirements, as well, and the high cutting volume, in particular, makes a plurality of machining operations necessary in order to finally achieve the required precision.

The object underlying the invention is therefore to improve a process of the generic type such that parts of this type can be produced with less resources and, therefore, less expensively.

SUMMARY OF THE INVENTION

This object is accomplished in accordance with the invention, in a process of the type described at the outset, in that by making a mold of a master having the section with a spirally symmetrical outer contour a casting mold member surrounding this section in a closed manner azimuthally to the axis of symmetry is produced and that with this casting mold member a casting corresponding to the part to be produced is produced in a casting mold during chilling leading to the shell hardening of the cast iron melt.

The advantage of the inventive process is to be seen in the fact that as a result of the casting mold member surrounding the section azimuthally and the filling of this member during chilling leading to the shell hardening of the cast iron melt, a casting can be produced which already has a spirally symmetrical outer contour and is, in particular, in one piece. This means that a considerable reduction in the production resources is already achieved since the geometry of the spirally symmetrical outer contour is already present in a manner close to the final contour or true to the final contour. Furthermore, the filling during chilling of the cast iron melt leading to the shell hardening has the advantages that, with it, the cast body which is, in particular, in one piece can be attained with defined high physical properties and the cast bodies have, in particular, a high quality of the material extending over large cross-sectional differences and are, preferably, essentially homogeneous and, in particular, essentially free from pores and cavities.

In this respect, it is particularly advantageous when the casting mold is filled by feeding with the cast iron melt and so, particularly when graphite is separated out, the graphitization pressure is utilized to prevent cavities and pores in the casting.

In order to obtain a structure which is as homogeneous as possible over the cross section, it is expediently provided for the casting to be produced with a vertically aligned axis of symmetry of the casting mold member.

With respect to the cast iron which is used for the production of the inventive part, no details have so far been given. In order to obtain a homogeneous structure, it is particularly advantageous when the cast iron is hardened in the casting mold essentially eutectically.

It is particularly favorable for the homogeneity of the structure obtained when the cast iron is hardened in the casting mold as a one-component system.

This may be achieved, in particular, when the casting mold is supplied with a cast iron melt near to the eutectic.

No details have been given concerning the production of the casting mold itself. It would, for example, be conceivable within the scope of the present invention for the casting mold to comprise solely the casting mold member. It is, however, even more advantageous when, for the production of the casting mold, the casting mold member is placed as insert between two mold halves so that additional mold elements of the casting to be produced and thereby forming a one-piece component can be predetermined and defined via the two mold halves. On the other hand, however, the section of the spirally symmetrical outer contour can likewise be produced with a casting mold although a spirally symmetrical outer contour is not suitable for casting molds having mold halves since mold halves for spirally symmetrical outer contours can, in many cases, not be produced due to the lack of release properties between mold half and master.

Within the scope of the present invention it is particularly advantageous when the mold halves are produced in the shell molding process or shell mold casting process since this process enables the production of thin-walled mold halves which are good heat conductors and these are necessary in order to facilitate the chilling required for the beam hardening of the cast iron melt. In addition, the shell molding process has the advantage that no inclined surfaces for mold release are required and, therefore, the casting can be produced with a smaller overmeasure than in conventional casting processes.

It is particularly advantageous within the scope of the inventive solution when the mold halves form a mold for at least one section of the part to be produced adjoining the section with the spirally symmetrical outer contour.

No details have been given in conjunction with the preceding description of individual embodiments concerning the production of the casting mold member. The casting mold member could, for example, be produced by a plurality of conceivable surface machining processes.

It is, however, particularly advantageous when the casting mold member is produced by making a mold of the master with molding material and subsequently screwing the master out of the casting mold member. In addition, it is expedient when the casting mold member is produced with a defined outer contour by making a mold in an outer mold container, particularly when the casting mold member is intended to be placed as insert in one mold half, in this case the mold half having a recess corresponding to the outer contour of the casting mold member.

A sand molding process, with which a mold of the master is made with the foundry sand for producing the inner contour of the casting mold member and, for example, also of the mold container for producing the outer contour, is particularly suitable for such a production of the casting mold member.

No details have been given in the above concerning the type of production of the final shape of the part having a spirally symmetrical outer contour in certain sections. It would, for example, be conceivable, particularly when the requirements with respect to the precision of the parts are lower, to produce these directly with their finished final contours in the original master process.

It is, however, particularly advantageous, particularly in order to achieve a high precision, when the section with the spirally symmetrical outer contour is produced as a casting with overmeasure and subsequently machined down to the customary shape so that, in particular, the high precision of the outer contour for screw compressors can be achieved but with less machining being required since the spirally symmetrical outer contour can already be produced close to the final contour.

The same applies for the section adjoining the section with the spirally symmetrical outer contour, for example stub shafts of the part, since mounting takes place in the region of these stub shaft extensions and, therefore, the receiving surface for the bearings must likewise be machined with high precision.

Centering surfaces are preferably created on the casting after the mold release by abrasive machining, the casting is then held at the centering surfaces and machine finished.

The machine finishing takes place, for example, by way of milling in one setup and subsequent grinding in an additional setup.

It is, however, particularly advantageous when the machine finishing of the casting is carried out in one setup after the centering surfaces have been produced. This machine finishing is a grinding, preferably high speed grinding.

It is particularly advantageous for the precision when the machine finishing is carried out on one machine.

It is even more advantageous when the production of the centering surfaces takes place on the same machine as the finishing.

No details have been given in the process described in the above concerning the cast iron used.

In principle, all possible variations of cast iron melts would be usable, for example also a cast iron melt which results in the cast iron with flake graphite. It is, however, particularly advantageous, especially in order to attain good surface qualities and good changing load strength and, in particular, a good ductility, as well, when a cast iron melt is used, with which cast iron with nodular graphite results in the casting. The structure is, preferably, predominantly pearlitic and slightly ferritic.

The invention relates, in addition, to a casting device for the production of parts made of cast iron with a section having an outer contour spirally symmetrical to the axis of symmetry, this casting device serving, in particular, to carry out the variation of the inventive process described in the above.

The inventive object is accomplished with such a casting device in that a casting mold has a casting mold member which surrounds the section with the spirally symmetrical outer contour in a closed manner azimuthally to the axis of symmetry and is molded by means of a master having the spirally symmetrical outer contour and that the casting mold is surrounded by a cooling body leading during casting to the shell hardening of a cast iron melt introduced into the casting mold.

The specified advantages may be achieved in the process described at the outset with such a casting mold, in particular a casting with a high homogeneity which is, in addition, shaped in the section with the spirally symmetrical outer contour close to the final contour or even true to the final contour so that complicated machining procedures at least are unnecessary.

No details have been given with respect to the design of the cooling body. It is, for example, advantageously provided for the cooling body to consist of steel pebbles which have a high heat capacity in order to attain a chilling effect for the formation of the shell hardening in the casting.

In this respect, it is particularly advantageous when the weight of the cooling body is at least 8 to 10 times the casting weight.

In order to attain a good transfer of heat, it is, in addition, advantageous when the wall thickness of the casting mold is at the most 10 mm; it is preferably provided for the wall thickness to be at the most 5 to 10 mm.

The casting mold could, in principle, be formed solely by the casting mold member. It is, however, particularly advantageous, in particular, in order to integrally mold additional sections to the section having the spirally symmetrical outer contour, when the casting mold comprises two mold halves, into which the casting mold member is inserted.

The mold halves are preferably designed such that they form a mold for at least one section of the part to be produced adjoining the section with the spirally shaped outer contour.

A particularly exact casting may be achieved when the mold halves are produced according to the shell molding or shell mold casting process since very precise molds can be produced with it.

In addition, the invention relates to a rotor for a screw compressor with a section having a spirally symmetrical outer contour, in particular a compression section, which is characterized in that this is produced according to the process described in the above or using the casting device described in the above.

Furthermore, the invention relates to a rotor for screw compressors with a compression section having a spirally symmetrical outer contour, which is characterized in accordance with the invention in that the rotor has in cross section at its outer contour, at least in certain regions, a shell-hardened structure consisting of cast iron with graphite separations.

In this respect, it is particularly advantageous when the rotor has in the region of its spirally symmetrical outer contour a shell-hardened structure consisting of cast iron with graphite separations.

Furthermore, the invention relates to a part consisting of cast iron with an outer contour spirally symmetrical to an axis of symmetry, in particular a rotor for a screw compressor with a compression section having the spirally symmetrical outer contour, which is characterized in accordance with the invention in that this has a structure which is homogeneous over a cross section of the section having a spirally symmetrical outer contour.

In this respect, it is particularly advantageous when the structure is in cross section completely pore-free and cavity-free, whereby pores and cavities are to be understood as hollow spaces which are visible and larger than approximately 1/10 mm in diameter.

Such a part can preferably be attained when this is produced according to an embodiment of the process described in the above.

A particularly preferred embodiment of an inventive part has, in addition to the spirally symmetrical outer contour, additional molded elements, for example shaft extensions, which are likewise cast in one step with the spirally symmetrical outer contour so that the structure, for example the structure obtained due to the feeding, extends through the entire, one-piece body and, therefore, the properties which are advantageous with this structure in conjunction with the simple, inexpensive production relate to this entire, one-piece body.

Additional features and advantages of the invention are the subject matter of the following description as well as the drawings illustrating the invention. In the drawings,

DETAILED DESCRIPTION OF THE INVENTION

Figure 1:
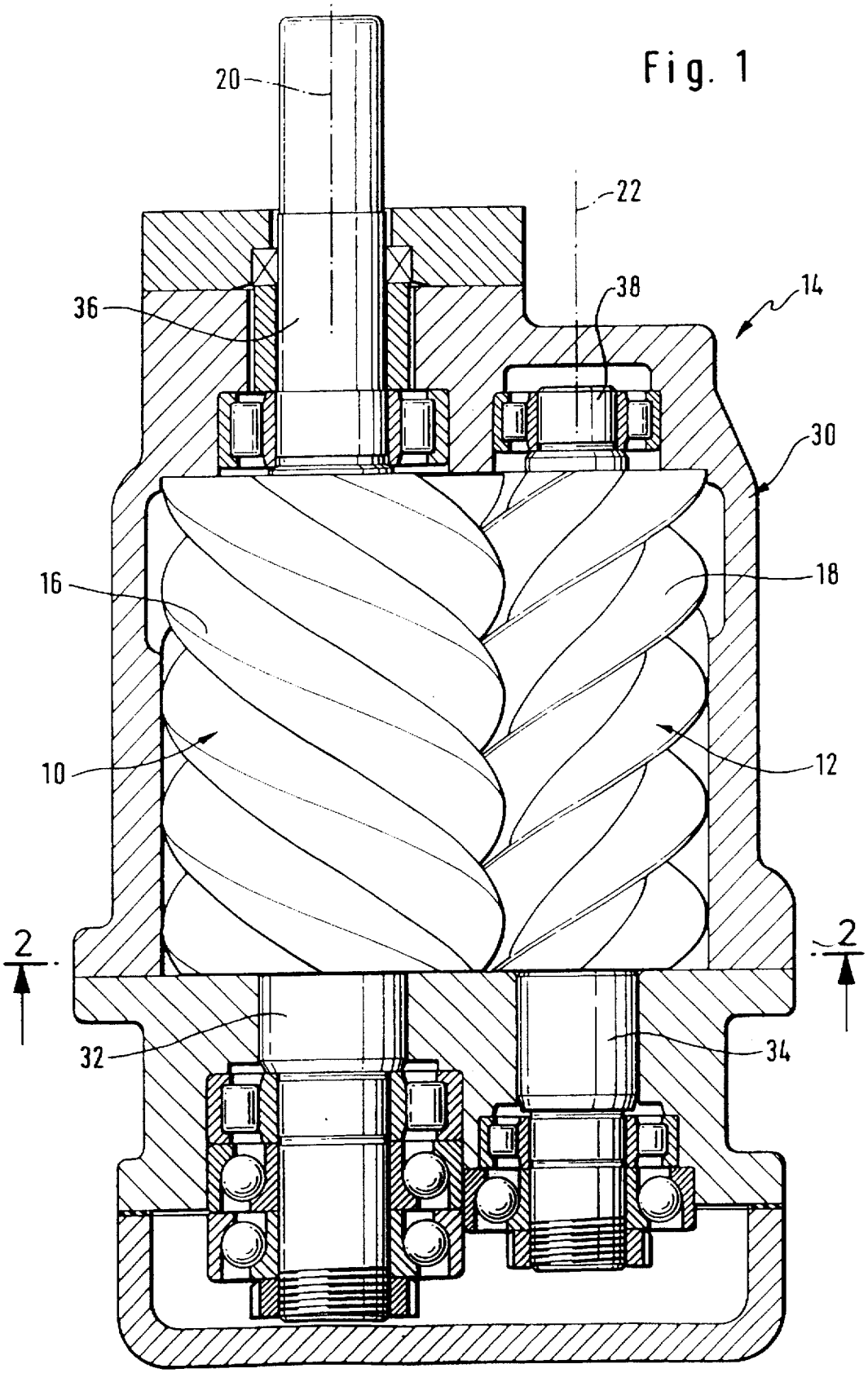
FIG. 1 is a longitudinal section through a screw compressor, in which parts with a spirally symmetrical outer contour are used as rotors.
Figure 2:
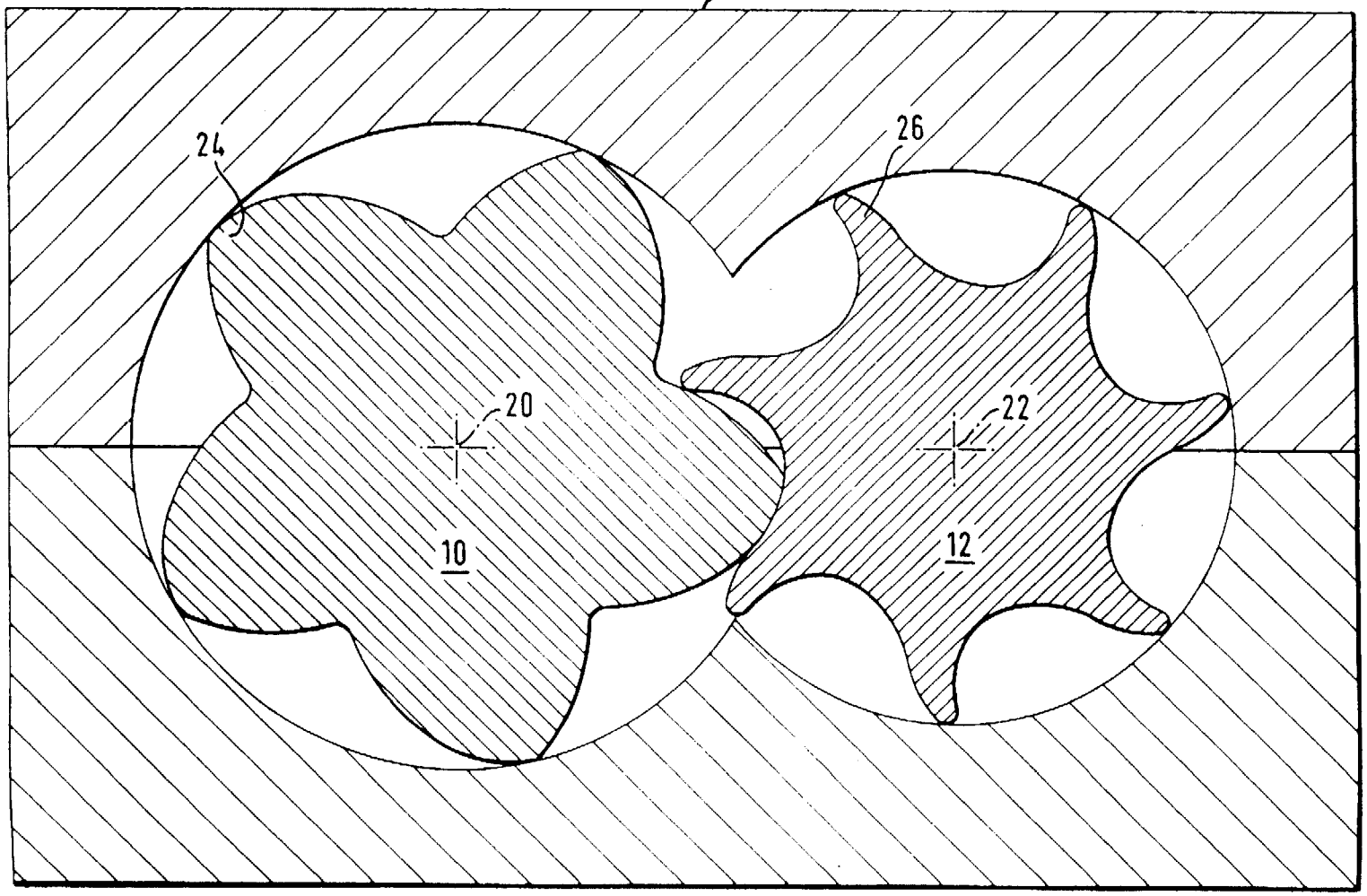
FIG. 2 is a section along line 2—2 in FIG. 1 and, in particular, through the rotors having a spirally symmetrical outer contour.

The parts produced according to the invention are, for example, rotors 10, 12 of screw compressors 14 illustrated in FIGS. 1 and 2. Each of the rotors 10 and 12 is designed as a one-piece part with a section 16 and 18, respectively, having a spirally symmetrical outer contour, in the following designated simply as spirally symmetrical section, in which an outer contour of the rotors 10, 12 has a plurality of screw cams 24 and 26, respectively, which extend spirally to an axis of symmetry or screw axis 20 and 22, respectively. The screw cams have different cross-sectional shapes, the cross-sectional shapes being designed such that the screw cams 24 and 26, respectively, of the two rotors 10 and 12 engage sealingly in one another. The cross-sectional shape of the screw cams 24 and 26 is different but mutually adapted such that when the rotors 10 and 12 rotate relative to one another a medium is compressed by them.

For this purpose, the rotors 10 and 12 are arranged in a housing which is designated as a whole as 30 and encloses the spirally symmetrical sections 16 and 18 in an essentially sealed manner.

Each of the rotors 10 and 12 is, in addition, provided with integrally formed stub shafts 32 and 34, respectively, and 36 and 38, respectively, on both sides of the spirally symmetrical sections 16 and 18 and coaxial to the axis of symmetry 20 and 22, respectively. The rotors 10 and 12 are mounted for rotation in the housing 30 with these stub shafts. One of the stub shafts, for example the stub shaft 36, is thereby guided to a drive motor not illustrated in FIG. 1 and is driven by it.

Figure 3:
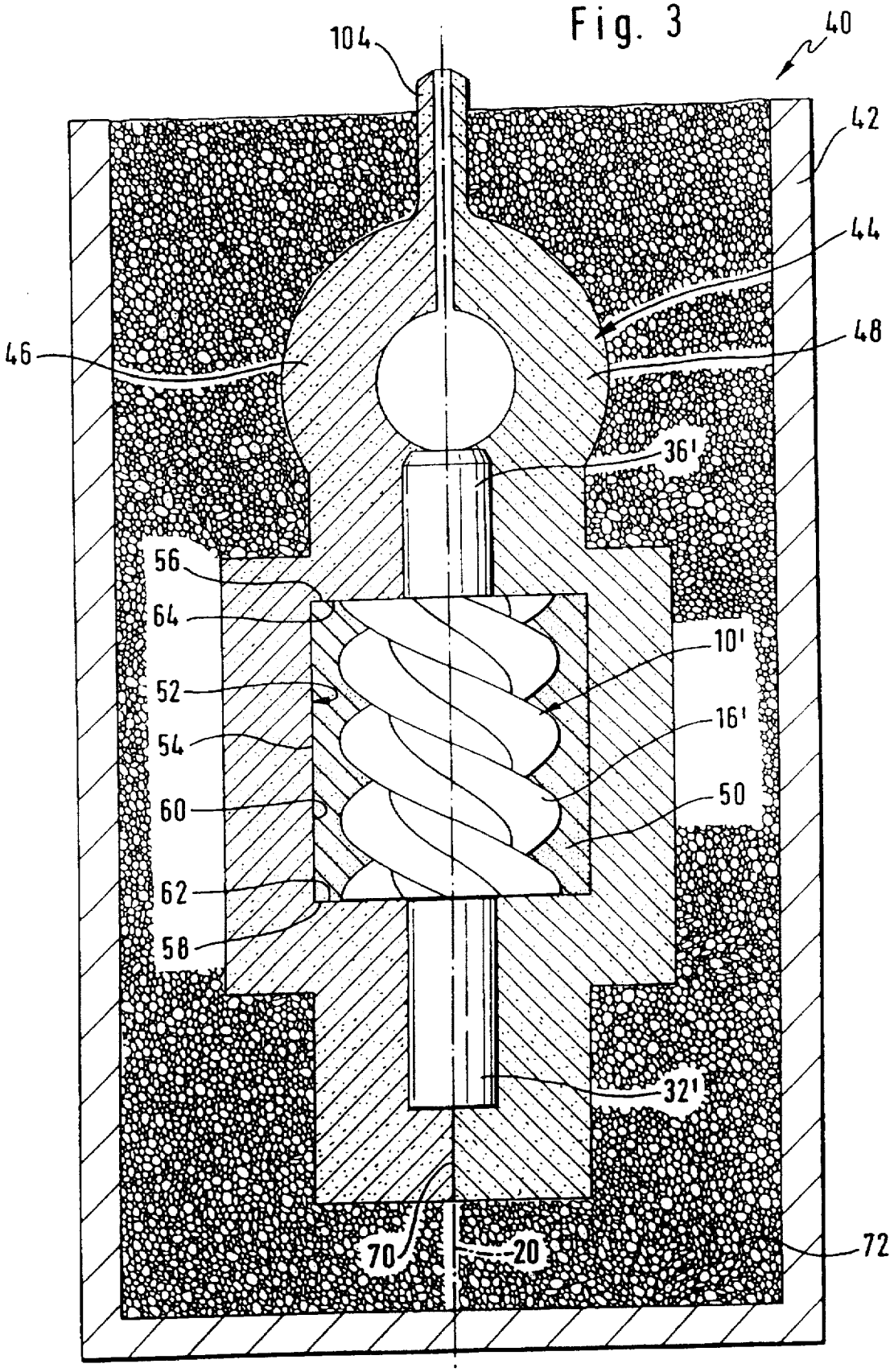
FIG. 3 is a vertical section through a device for the production of a casting for such a rotor.

In accordance with the invention, the production of the rotors 10 or 12, for example the rotor 10, takes place in a casting device which is designated as a whole as 40 in FIG. 3 and comprises a box 42, in which a casting mold designated as a whole as 44 is arranged. In this casting mold a casting 10' of the rotor 10 can be produced, the entire casting 10' representing a part cast in one piece which comprises not only the spirally symmetrical section 16' but also the two stub shafts 32' and 36'. The designation of the individual elements with a prime mark is intended to express the fact that these do not have the final measurement but are oversize.

The casting mold 44 comprises, for its part, two shell mold halves 46 and 48 which are produced in accordance with the known shell molding process described, for example, in the book "Gießereiformstoffe", VEB-Verlag Technik Berlin, 1955 edition, author: Dr. R. Grochalski. These shell mold halves 46 and 48 form a mold for the stub shaft extensions 32' and 36' which extend on both sides of the spirally symmetrical section 16'.

The mold for the casting of the spirally symmetrical section 16' is formed by a casting mold member 50 which surrounds the spirally symmetrical section 16' in a closed manner in the azimuthal direction in relation to the axis of symmetry 20 and is inserted into a corresponding recess 52 in the two shell mold halves 46 and 48. For this purpose, the casting mold member 50 has, for example, an outer cylinder surface 54 cylindrical to the axis of symmetry 20 as well as end faces 56 and 58 and the recess 52 has an inner cylindrical surface 60 as well as annular surfaces 62 and 64 limiting this and forms with these an accurately fitting receiving means for the casting mold member 50.

A plane of division 70 of the two shell mold halves 46 and 48 is placed such that the axis of symmetry 20 of the rotationally symmetrical section 16 is also located in this plane and forms at the same time the axis of symmetry for the two stub shafts 32' and 36'.

The casting mold comprises the two shell mold halves 46 and 48 as well as the casting mold member 50 inserted into them. This member is arranged in the box 42 such that the axis of symmetry 20 extends in a vertical direction. Furthermore, the casting mold is surrounded in the box 42 by a cooling body 72 which is formed by a filling consisting of steel pebbles surrounding the casting mold 44. The filling consisting of steel pebbles thereby surrounds the entire casting mold 44 and has a mass which corresponds approximately to 8 to 10 times the mass of the casting 10' of the rotor.

In order to attain an effective cooling by means of the cooling body 72 the casting mold 44 is designed such that it preferably has a wall thickness located between the casting 10' and the cooling body 72 of 5 to 8 mm so that a suitable thermal coupling is possible between the cast iron melt filling the casting mold and the cooling body 72.

Figure 4:
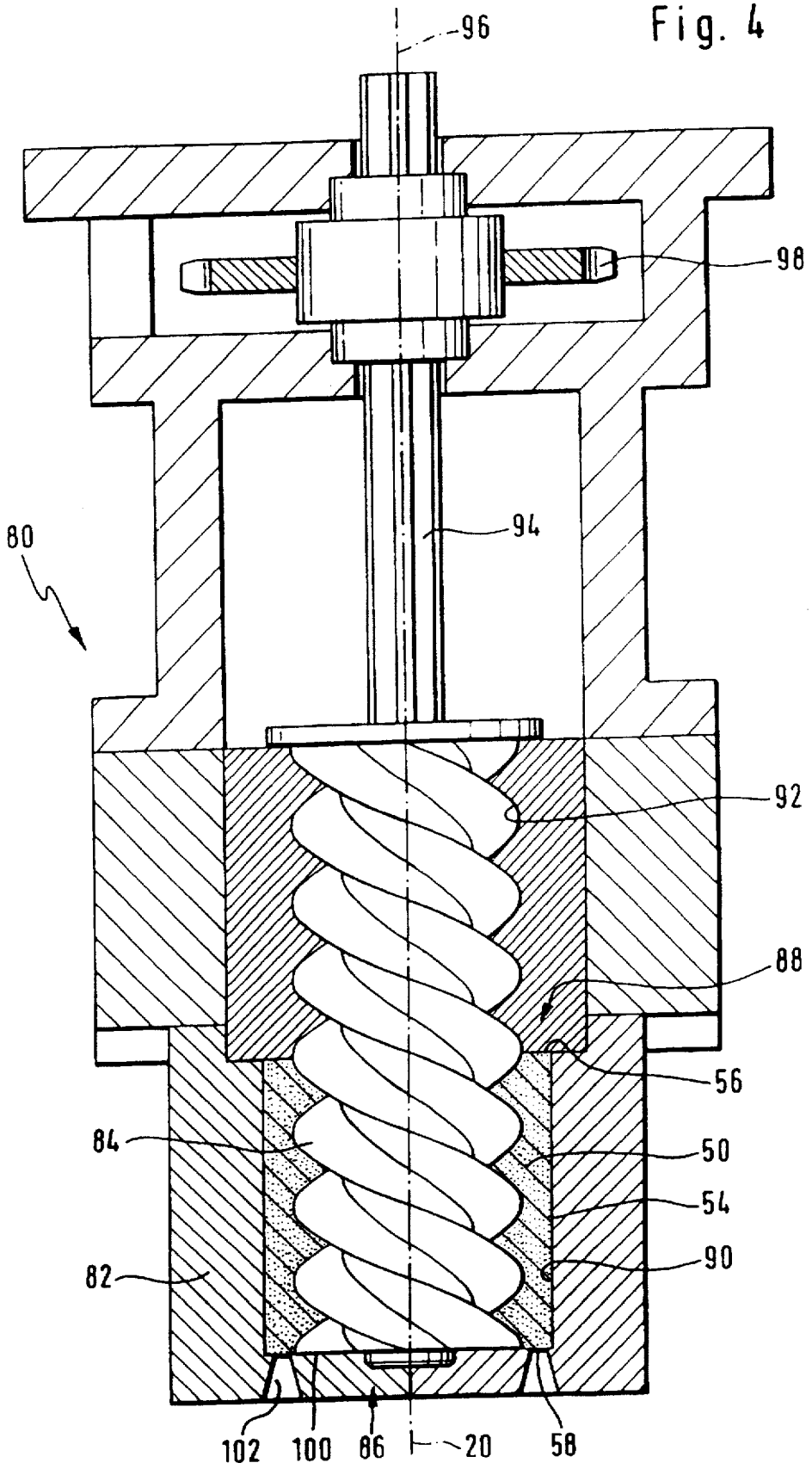
FIG. 4 is a longitudinal section through a device for the production of a casting mold member for a casting mold according to FIG. 3.

The production of the casting mold member 50 is carried out, as illustrated in FIG. 4, by means of a molding device designated as a whole as 80 which has a mold container 82, into which a master 84 for the spirally symmetrical section 16' can be inserted. The mold container 82 comprises a bottom 86 and can be closed by a cover 88, an inner wall 90 of the mold container 82 defining the cylindrical outer cylinder surface 54, the bottom 86 the end face 58 and the cover 88 the end face 56. The cover 88 is thereby designed such that it has a passage 92 corresponding to an outer contour of the master 84 so that the master 84 extends through this passage with its spirally symmetrical outer contour and, therefore, can also be screwed through the cover 88.

The master 84 is, in addition, non-rotatably connected to a shaft 94 which passes through a drive wheel 98 when displaced in the direction of its axis of rotation 96 but is non-rotatably connected to the drive wheel 98 so that by turning the drive wheel 98 the entire master 94 can be screwed out through the cover 88.

The exact guidance of the master 84 is preferably carried out by the passage 92 in the cover which is shaped in accordance with the outer contour and the length of which in the direction of the axis of symmetry 20, which extends coaxially to the axis 96, corresponds at least approximately to the extension of the master 84 in the mold container 82.

For the production of the casting mold member 50, the master 84 is screwed into the mold container 82 to such an extent until it is seated with its end side 100 on the bottom 86 of the mold container 82. Subsequently, sand is shot under pressure into the space between the master 84 and the mold container 82 with the bottom 86 and the cover 88 through openings 102 by means of a core shooter and set in a conventional manner so that the hardened sand forms the casting mold member 50. Following the hardening, the master 84 is screwed out of the casting mold member 50 by turning the drive wheel 98, the cover 88 is subsequently lifted off and the casting mold member 50 removed from the mold container 82.

This casting mold member 50 can then be inserted into the two shell mold halves 46 and 48 produced in accordance with the conventional shell molding process in order to form the casting mold 44.

The shell mold halves 46 and 48 are produced from a sand-resin mixture customary for the shell molding process and hardened.

It is particularly advantageous, especially when a good cooling of the spirally symmetrical section 16' is required, to produce the casting mold member 50 from a mixture of quartz sand, chromium ore and zircon sand.

The casting mold 44 embedded in the cooling body 72 is filled with an essentially eutectic cast iron melt via a feeder 104 with vertical alignment of the axis of symmetry 20, the cast iron melt hardening in the casting mold 44 essentially eutectically and due to the chilling by the cooling body by way of a shell hardening. In addition, the supply is carried out by way of the feeding analogous to the feeding known from chill casting (such as described, for example, in the technical paper of K. Näser, Dipl. Ing., entitled HD Sondergußβ in "Der Konstrukteur" 3/83) so that the formation of cavities is prevented due to the graphitization pressure forming in the casting mold 44. The cast iron melt used is preferably a melt of such a type that the casting 10' has a structure consisting of cast iron with nodular graphite so that a GGG material, in particular GGG70, preferably results.

The structure is, favorably, essentially pearlitic and slightly ferritic, preferably approximately 95% pearlitic and 5% ferritic.

Following the mold release of the casting 10', the mechanical abrasive machining takes place, for example only by milling or only by grinding, in the region of the spirally symmetrical section 16' so that after removal of the overmeasure the spirally symmetrical section 16 of the rotor 10 results and, in addition, a corresponding machining of the stub shaft extensions 32' and 36' takes place in order to obtain the stub shafts 32 and 36.

The casting 10' is preferably clamped following the mold release and in this setup centering surfaces are machined which are either receiving means for tips or centers or comprise at least one receiving means for clamping the workpiece or non-rotatable holding and an additional such receiving means or a receiving means for a center.

Figure 5:
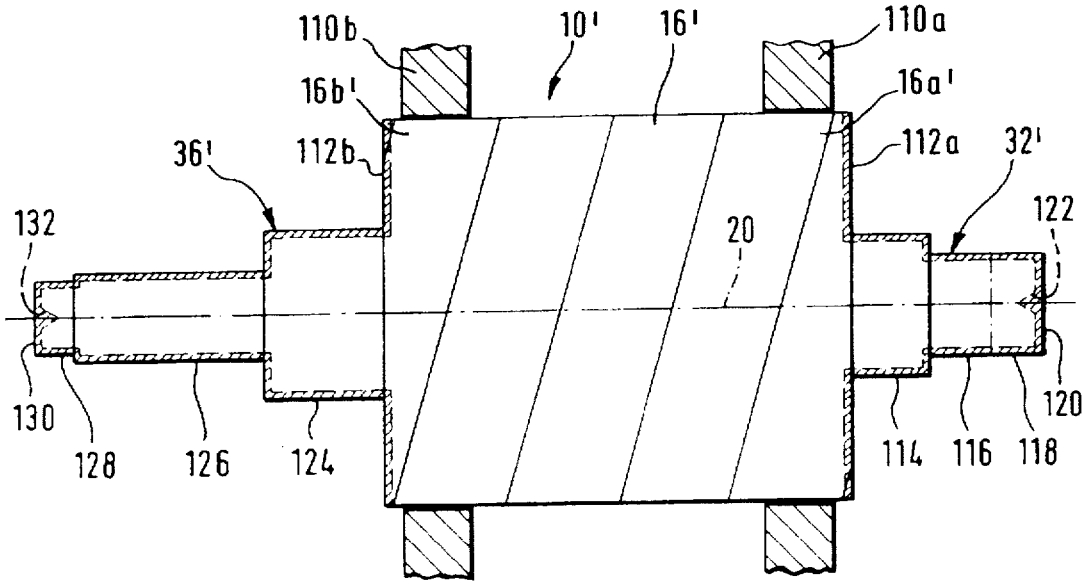
FIG. 5 is an illustration of a first setup of an inventive casting for a rotor for the mechanical abrasive machining.

For this purpose, in particular, as illustrated in FIG. 5, the casting 10' is clamped in the spirally symmetrical section 16', preferably in the end regions **16*a'* and 16*b'*, with a respective set of clamping jaws 110*a* and 110*b*, such a clamping of the spirally symmetrical section 16' being possible in a simple manner because this is produced in accordance with the shell molding process and, therefore, already has a high precision in the region of the circumferential surface, in which clamping with the sets of clamping jaws 110*a* and 110*b*** takes place, due to this casting process.

In this first setup by means of the sets of clamping jaws **110*a* and 10*b*, illustrated in FIG. 5, end faces 112*a* and 112*b* of the spirally symmetrical section 16' and the stub shaft extensions 32' and 36'** are machined.

For example, in the case of the stub shaft extension 32', the machining of a cylinder surface 114 takes place following the end face **112*a* and following this the machining of a cylinder surface 116 which is set back in relation to the cylinder surface 114** and preferably serves to receive the bearings.

The cylinder surface 116 is followed by the machining of a threaded section 118 at the end.

An end face 120 of the stub shaft extension 32' is machined at least to the extent that a conical centering bore 122 coaxial to the axis 20 is made in this.

Moreover, following the end face **112*b*, the stub shaft extension 36' is, for example, likewise machined such that, first of all, the machining of a cylinder surface 124 which adjoins the end face 112*b* takes place, then the machining of a cylinder surface 126 which is set back in relation to the cylinder surface 124 and preferably forms a stub shaft, and following that the machining of an entraining surface 128 at the end which is likewise set back radially in relation to the cylinder surface 126. Subsequently, a machining of an end face 130 of the stub shaft 36' takes place to the extent that a conical centering bore 132 coaxial to the axis 20** is likewise made.

All the machining operations on the end faces **112*a* and 112*b* and the cylinder surfaces 114, 116, 124, 126 and 128** preferably take place in the first setup in the form of a preliminary turning of these surfaces.

After the machining of the centering surfaces, the casting 10' is held with these and either machine finished with a milling operation and a subsequent grinding operation or machine finished in one machine in one setup, in particular by high-speed grinding.

Figure 6:
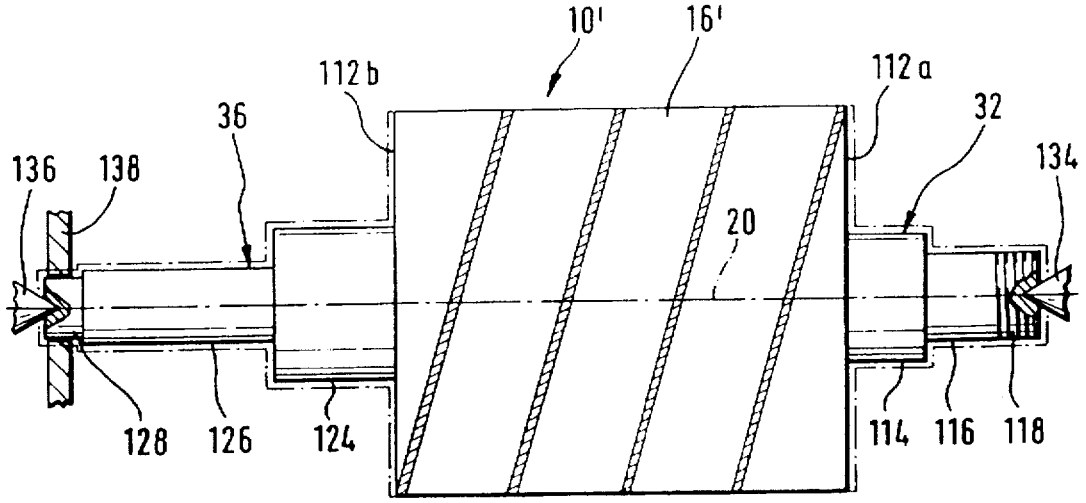
FIG. 6 is an illustration of a second setup of the casting for the machine finishing.

In the second setup, as illustrated in FIG. 6, the casting 10' is, for example, held in the centering bores 122 and 132 between centers 134 and 136 and clamped additionally in the region of the gripping surface 128 by means of jaws 138 for introducing torque.

In this second setup between the centers 134 and 136, illustrated in FIG. 6, a finish grinding of the cylinder surfaces 114, 116, 124 and 126 as well as of the end faces **112*a* and 112*b* takes place and, moreover, a finish grinding of the spirally symmetrical section 16'** to achieve the final outer contour of this spirally symmetrical section.

The inventive rotor 10' is finished after machining of the casting 10' in the setup according to FIG. 6.

The gripping surface 128 remains on the finished part and does not interfere during its use.

The advantage of the invention is that a high precision of the finished workpiece can be achieved and this makes, for example, the selection of fitting, finished pairs of rotors unnecessary since all the rotors can be produced with an adequately high precision with little abrasive machining.

What is claimed is:

1. A process for the production of a part made of cast iron comprising a rotor for a screw compressor having a compression section with an outer contour which is spirally symmetrical to an axis of symmetry, comprising the steps of:

producing a casting mold member from a master having said compression section, such that said casting mold member surrounds said master in an azimuthally closed manner with respect to said axis of symmetry;

providing a casting mold by placing said casting mold member as an insert in an outer mold;

producing said rotor as a casting by (a) feeding a cast iron melt into said casting mold (b) cooling said cast iron melt in said casting mold member, and (c) adapting the feeding conditions and cooling conditions so as to produce a graphitization pressure due to graphite separating out from said cast iron melt during solidification of said cast iron melt to prevent cavities and pores in the casting, and to chill facial regions of said cast iron melt in said casting mold to obtain shell hardening of said cast iron melt therein.

2. A process as defined in claim 1, wherein:

during solidification, graphite is separated in the form of at least one of flake graphite and nodular graphite.

3. A process as defined in claim 1, wherein the casting takes place with the axis of symmetry of the casting mold member standing vertical.

4. A process as defined in claim 1, wherein the cast iron hardens in the casting mold essentially eutectically.

5. A process as defined in claim 1, wherein the casting mold is supplied with a cast iron melt near to the eutectic.

6. Process as defined in claim 1, wherein said outer mold comprises two mold halves.

7. A process as defined in claim 1, wherein the mold halves are produced in a shell molding process or shell mold casting process.

8. A process as defined in claim 1, wherein the mold halves form a mold for at least one section of the part to be produced adjoining the section.

9. A process as defined in claim 1, wherein the casting mold member is produced by making a mold of the master with molding material and subsequently screwing the master out of the casting mold member.

10. A process as defined claim 1, wherein the casting mold member is produced with a defined outer contour by making a mold in an outer mold container.

11. A process as defined in claim 1, wherein the section with the spirally symmetrical outer contour is produced as a casting with overmeasusre and subsequently machined down to the final shape.

12. A process as defined in claim 11, wherein the casting is provided with centering surfaces and then machine finished.

13. A process as defined in claim 12, wherein the casting is held in the region of the spirally symmetrical outer contour for the provision with the centering surfaces.

14. A process as defined in claim 12, wherein the machine finishing is carried out with a single setup at the centering surfaces.

15. A process as defined in claim 11, wherein the machining down to the final shape is carried out on one machine.

16. A process as defined in claim 1, wherein:

said chilling step comprises the step of providing a cooling body which surrounds said casting mold.

17. A process for the production of a part made of cast iron comprising a rotor for a screw compressor having a compression section with an outer contour which is spirally symmetrical to an axis of symmetry, comprising the steps of:

producing a casting mold member from a master which has said compression section, such that said casting mold member surrounds said master in an azimuthally closed manner with respect to said axis of symmetry;

providing a casting mold by placing said casting mold member as an insert between two mold halves;

filling said casting mold with a cast iron melt; and chilling said cast iron melt in said casting mold to obtain shell hardening of said cast iron melt.

* * * * *